US006615904B2

(12) United States Patent
Lindgren

(10) Patent No.: US 6,615,904 B2
(45) Date of Patent: Sep. 9, 2003

(54) METHOD FOR DETECTING A MISALIGNED ROLLER PORTION OF A ROLLER

(75) Inventor: Håkan Lindgren, Göteborg (SE)

(73) Assignee: Aktiebolaget SKF, Göteborg (SE)

( * ) Notice: Subject to any disclaimer, the term of this patent is extended or adjusted under 35 U.S.C. 154(b) by 0 days.

(21) Appl. No.: 10/151,865

(22) Filed: May 22, 2002

(65) Prior Publication Data

US 2002/0174970 A1 Nov. 28, 2002

(30) Foreign Application Priority Data

May 23, 2001 (SE) ..... 0101838

(51) Int. Cl.[7] ..... B22D 11/128; B22D 11/20
(52) U.S. Cl. ..... 164/454; 164/413; 164/151
(58) Field of Search ..... 164/454, 151, 164/151.2, 413

(56) References Cited

U.S. PATENT DOCUMENTS 4,056,140 A * 11/1977 Ives et al. ..... 164/454
6,470,957 B1 * 10/2002 Ashburn ..... 164/454
2002/0121426 A1 9/2002 Lindgren

* cited by examiner

*Primary Examiner*—Kuang Y. Lin
(74) *Attorney, Agent, or Firm*—Burns, Doane, Swecker & Mathis, LLP

(57) ABSTRACT

A method for detecting a misaligned roller portion of a roller in a continuous casting machine, in which the machine includes rollers arranged in a row after each other, with the rollers being divided into at least two roller portions each rotatably mounted in supporting members and arranged for transporting produced material. The method involves measuring the radial load exerted by the material on each supporting member of the roller portions of a roller, comparing the radial loads of the supporting members at the outer ends of the roller with each other, comparing the radial loads of the supporting members at the inner ends of the roller with each other, and determining a misaligned roller portion where the divergence between the radial loads of the supporting members of the outer ends of the roller and/or the supporting members of the inner ends of the roller exceed a predetermined value.

12 Claims, 2 Drawing Sheets

METHOD FOR DETECTING A MISALIGNED ROLLER PORTION OF A ROLLER

This application is based on and claims priority under 35 U.S.C. §119 with respect to Swedish Application No. 0101838-1 filed on May 23, 2001, the entire content of which is incorporated herein by reference.

FIELD OF THE INVENTION

This invention generally relates to continuous casting machine. More particularly, the invention pertains to a method for detecting a misaligned roller portion of a roller in a continuous casting machine.

BACKGROUND OF THE INVENTION

A continuous casting machine produces steel material from molten steel. This steel material can, for example, be used as a starting material in rolling processes for producing sheet metal used in, for example, vehicles.

In the continuous casting machine, molten steel flows from a ladle and down in a tundish from which it is transported further down into a mold. In the mold, which is water-cooled, the slab of continuous cast material begins to form a solid shell. Then, the slab is continuously transported along a curved track by a large number of rollers arranged in segments, which continue to shape and cool the slab to the final thickness of the steel material. At the end of the track, the material is cut into suitable pieces.

The rollers of the continuous casting machine are mounted with their axes substantially perpendicular to the longitudinal extension of the curved track. To lead and support the slab of continuous cast material, the rollers are arranged in pairs each comprising an upper roller and a lower roller.

Further, the rollers are rotatably mounted in supporting members at each end of the rollers. Due to the length of the rollers and thus the load on the rollers, the rollers are generally split into at least two roller portions. The roller portions are either independently mounted in supporting members or non-rotatably provided on a common shaft, with the shaft being mounted in supporting members. The supporting members can be, for example, rolling bearings or sliding bearings. Further, the supporting member can also comprise a suitable bearing housing.

As described in the applicant's Swedish Patent Application No. 0100612-1, the slab must be fully and evenly supported by the rollers to obtain a cast material with high quality. If the support is not satisfactory, cracks can arise in the material due to bending forces. These cracks can be either internal cracks or surface cracks, both types of which lead to decreased quality, as a material having cracks will be almost impossible to roll. Surface cracks can be treated by costly treatment after the casting process. One way of treating the surface cracks is to weld them while another way is to grind off the surface layer of the material. However, both alternatives are expensive and sometimes cannot give a perfect result. As a result, the steel may have to be classified in a lower quality class. Material with internal cracks cannot be treated and must be classified in a lower quality class or discarded.

Generally speaking, non-uniform support of the slab may be caused by different types of roller failures. The above-mentioned application describes a method for detecting roller failures which can be either bearing failures or mounting failures. Both types of failures lead to misalignments of single rollers and/or entire segments of rollers, i.e., the rollers and/or segments are not aligned with the longitudinal extent of the track of the continuous casting machine.

However, the application mentioned above does not deal with the problem of misaligned roller portions of a roller. As described above, the rollers are generally split into at least two roller portions that are either independently mounted in supporting members or non-rotatably provided on a common shaft, with the shaft being mounted in supporting members.

If the roller portions are provided on a common shaft, the alignment between the roller portions will naturally be correct. If the roller portions are instead independently mounted in supporting members, there is a need to adjust them to an imagined horizontal line forming a "roller". The alignment of the roller portions of each roller is measured with conventional measuring equipment such as, for example, a ruler. Adjustments can be made, for instance, by using shims at the bearing housings.

Afterwards, several rollers are mounted together forming a segment, which segment is placed in the machine aligned with the longitudinal extension line of the track of rollers. During the mounting of these segments in the continuous casting machine, it is very likely that the alignment between the roller portions of the rollers is more or less destroyed or altered because of the size, weight and ungainliness of the segments.

When starting up the casting process, it is therefore important to check that all of the roller portions of a roller are correctly aligned with each other, i.e., so that the roller portions of a roller appear at or along an imagined horizontal line, with such horizontal line in turn being aligned perpendicular to the longitudinal extension (longitudinal extent) of the track of rollers. Unfortunately, it is usually very difficult to distinguish or identify a misaligned roller portion because the distance between a correctly aligned roller portion and a misaligned roller portion is typically very small.

Therefore, a need exists for a method for detecting a misaligned roller portion of a roller in a continuous casting machine.

SUMMARY OF THE INVENTION

According to one aspect, a method is provided for detecting a misaligned roller portion of a roller in a continuous casting machine, wherein the machine includes a plurality of rollers arranged in a row after each other, with the rollers being divided into at least two roller portions each rotatably mounted in supporting members and arranged for transporting produced material. The method includes measuring the radial load exerted by the material on each supporting member of the roller portions of a roller, comparing the radial load values of the supporting members arranged in the outer ends of the roller with each other, comparing the radial load values of the supporting members arranged in the inner ends of the roller with each other, and establishing the presence of a misaligned roller portion where the divergence between the load values of the supporting members of the outer ends of the roller and/or the supporting member of the inner ends of the roller are exceeding a predetermined value.

In accordance with another aspect, a method for detecting a misaligned roller portion of a roller in a continuous casting machine includes transporting material produced in the continuous casting machine along a plurality of rollers arranged in a row one after another, with at least one of the rollers being divided into at least two roller portions positioned axially adjacent one another and each rotatably mounted in two supporting members so that a supporting member is arranged at a first end of each roller portion and at a second end of each roller portion. The method also includes measuring a radial load value exerted by the material on the supporting members arranged at the first ends of the roller portions or the supporting members arranged at the second ends of the roller portions, comparing the measured radial load values of the supporting members with each other, and determining at least one of the roller portions is misaligned when the comparison of the measured radial load values of the supporting members reveals that a divergence between the measured radial load values of the supporting members exceeds a predetermined value.

According to another aspect, a method for detecting a misaligned roller portion of a roller in a continuous casting machine includes transporting material produced in the continuous casting machine along a plurality of rollers arranged in a row one after another, with at least some of the rollers being divided into at least two roller portions positioned axially adjacent one another and each rotatably mounted in supporting members so that a supporting member is arranged at each outer end of the at least one roller and at each inner end of the at least one roller, measuring a radial load value exerted by the material on the supporting members arranged at the outer ends of at least one roller, measuring a radial load value exerted by the material on the supporting members arranged at the inner ends of at least one roller, comparing the radial load values of the supporting members arranged at the outer ends of the at least one roller with each other, comparing the radial load values of the supporting members arranged at the inner ends of the at least roller with each other, and establishing that at least one of the roller portions is misaligned when a divergence between the radial load values of the supporting members at the outer ends of the at least roller and/or where a divergence between the radial load values of the supporting members of the inner ends of the at least one roller exceed a predetermined value.

BRIEF DESCRIPTION OF THE DRAWING FIGURES

The foregoing and additional features and characteristics of the present invention will become more apparent from the following detailed description considered with reference to the accompanying drawing figures in which like reference numerals designate like elements.

DETAILED DESCRIPTION OF THE INVENTION

Figure 1:
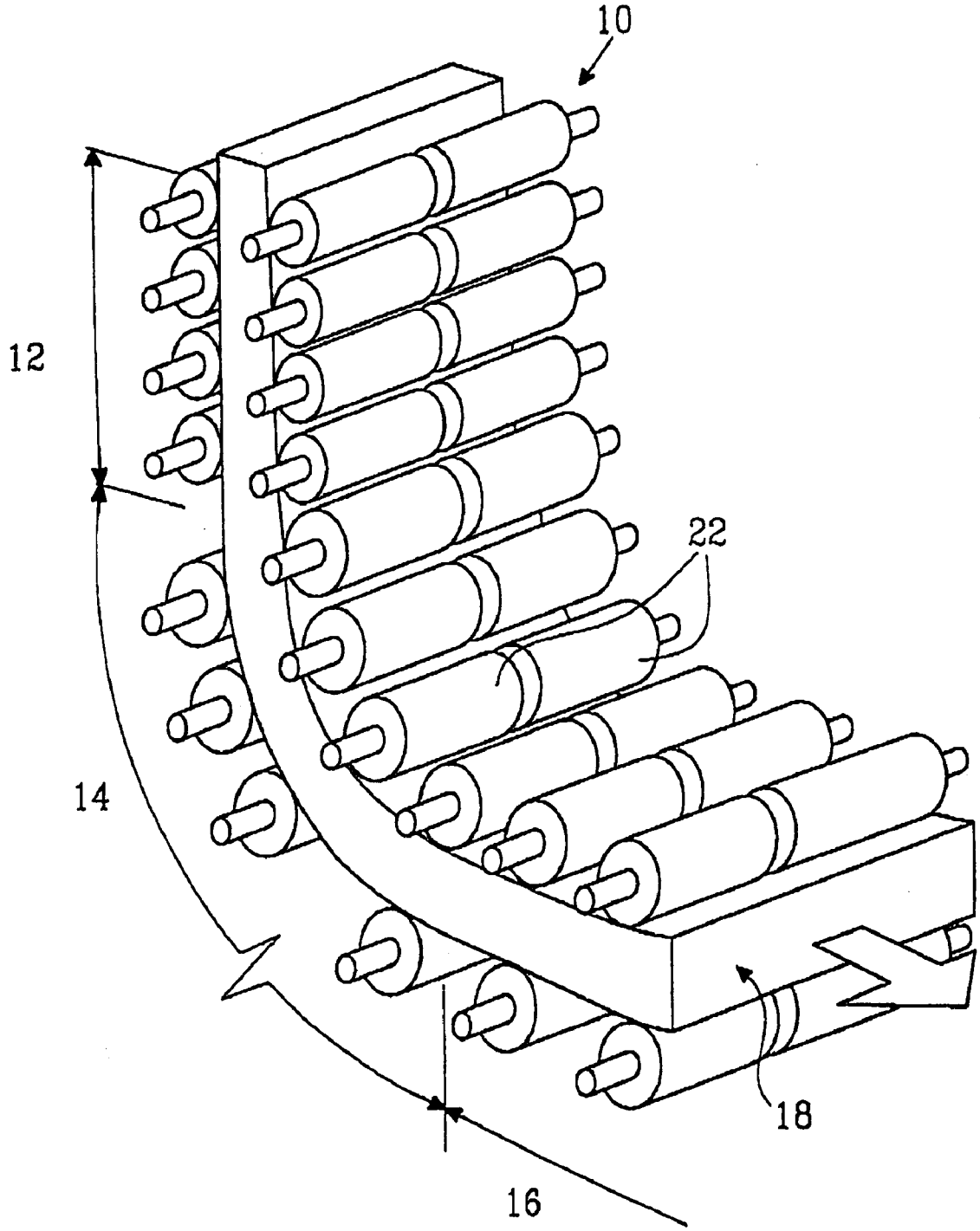
FIG. 1 is a schematic perspective view a set of rollers of a continuous casting machine.

FIG. 1 schematically illustrates a row of rollers 10 forming a section of a continuous casting machine. The illustrated rollers are arranged in pairs and form a top segment 12, an inside cooling chamber 14 and an outside cooling chamber 16. The pairs of rollers 10 lead and support the continuous length of slab 18 of the continuous cast material. In the top segment 12, the slab 18 has a more or less liquid core. However, during feeding under continuous movement in the direction shown by the arrow, the slab 18 will solidify as it is cooled off.

The rollers 10 are each mounted so that the axis of each roller is substantially perpendicular to the longitudinal extent of the track. The rollers 10 are rotatably mounted in supporting members 20 at each end of each roller 10. By way of example, the supporting members 20 can be rolling bearings or sliding bearings as schematically illustrated in FIGS. 2 and 3.

Generally, each of the rollers 10 is split into at least two roller portions 22. The roller portions 22 forming each roller are positioned axially after or axially adjacent each other, with the roller portions 22 being either independently mounted in supporting members 20 or non-rotatably provided on a common shaft, with the shaft being mounted in supporting members.

If the roller portions 22 are independently mounted in supporting members, a need exists to adjust the roller portions 22 to an imagined horizontal line forming a "roller". The alignment of the roller portions 22 can be measured with conventional measuring equipment, such as for instance a ruler. By use of, for example, shims, adjustments to the imagined horizontal line can be made at the supporting members 20.

Figure 2:
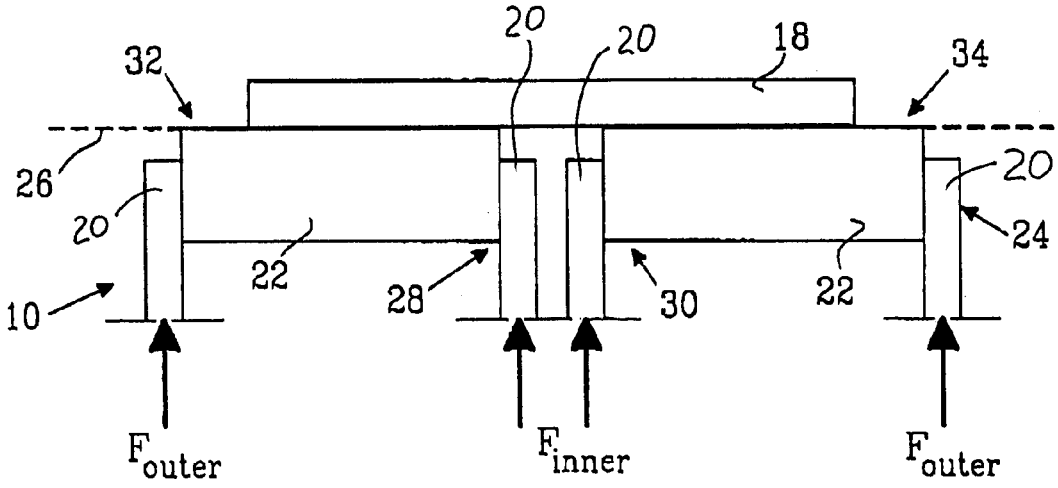
FIG. 2 is a schematic front view of two roller portions of a roller which are correctly aligned.
Figure 3:
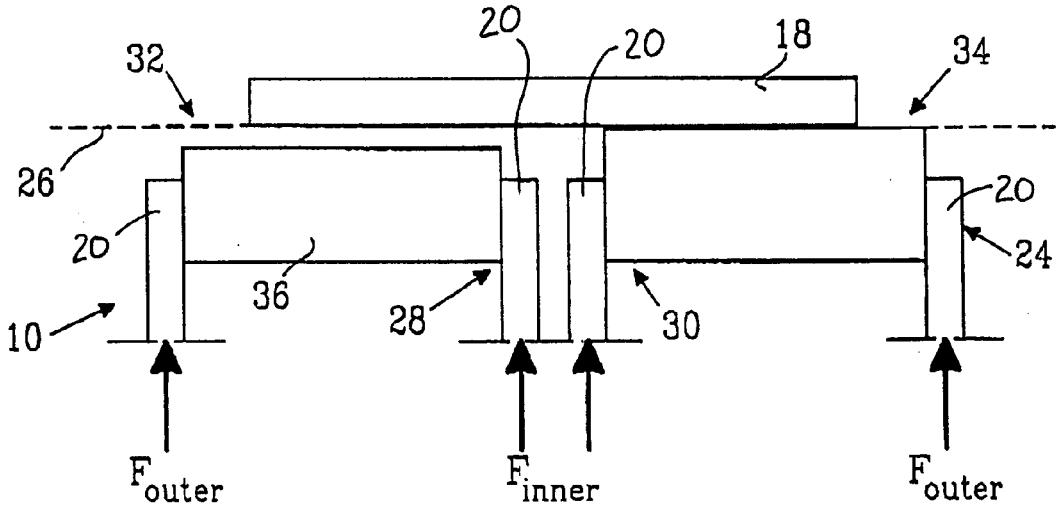
FIG. 3 is a schematic front view similar to FIG. 2, but with one of the roller portions not being aligned with the imagined horizontal line of the roller.

Referring to FIGS. 2 and 3, an example of the present invention will be described. Only one row of rollers 10 in the continuous casting machine will be considered as the loads on the two rows do not significantly affect each other due to the molten core of the slab 18. The example is only described in the case of an initial misalignment, i.e., the case of a mounting failure of the roller portion 22 of a roller 10 that can be detected during the beginning of the casting process. A similar misalignment can of course also occur during the casting process if one or several supporting members 20 for instance fail.

In the example, and with reference to FIG. 2, a roller 10 is considered which is made up of two roller portions 22, with the two roller portions 22 being individually mounted in supporting members 20. If the roller portions 22 of the roller 10 are aligned with each other, like in FIG. 2, they will appear as an imagined horizontal line 26. This imaginary horizontal line is in turn perpendicular to the longitudinal extension line or longitudinal extent of the track of rollers 10. However, in FIG. 3, one of the roller portions 22 of the roller 10 is misaligned with respect to the horizontal line 26, and consequently also to the track of the continuous casting machine.

The method of the present invention provides a mechanism for relatively easily establishing whether or not the roller portions 22 of a roller are misaligned. Briefly stated, the method comprises measuring the radial load, denoted F in the FIGS. 2 and 3, exerted by the elongated or continuous material on each supporting member 20 of the roller portions 22 of a roller 10, and then comparing the values between themselves to see that each supporting member 20 is carrying a reasonable load. Preferably, the radial load values of the supporting members 20 arranged at the outer ends 32, 34 of the roller are compared with each other and the radial load values of the supporting members 20 arranged at the inner ends 28, 30 of the roller 10 are compared with each other.

Then, the presence of a misaligned roller portion 22 can be established where the divergence between the load values of the supporting members 20 of the outer ends 28, 30 of the roller 10 and/or the supporting members 20 of the inner ends 32, 34 of the roller 10 exceed a predetermined value. An acceptable divergence is calculated in advance or thoroughly tried out.

For example, referring to FIG. 2 and assuming the slab 18 is located principally concentric on the roller portions 22, the two roller portions 22 in the schematic example are correctly aligned when the two supporting members 20 supporting the inner ends 28, 30 of the roller portions 22 (i.e., the ends which are facing each other) carry substantially the same load and when the two supporting members 20 supporting the outer ends 32, 34 of the two roller portions 22 carry substantially the same load. This is the "ideal" load pattern and in FIG. 2 the reaction forces in the supporting members 20 are denoted $F_{inner}$ for the forces acting in the supporting members 22 at the inner ends 28, 30 of the roller portions, while the reaction forces in the supporting members 20 are denoted $F_{outer}$ for the forces acting in the supporting members 20 at the outer ends 32, 34 of the roller portions 22.

If the load pattern significantly differs from this "ideal" load pattern, at least one of the roller portions 22 is likely to be misaligned from the imagined horizontal line 26 which is perpendicular to the longitudinal extent of the track of rollers.

In FIG. 3 the roller 10 of FIG. 2 is shown, where one of the roller portions 36 is misaligned. Here, the two inner reaction forces $F_{inner}$, are not equal and the two outer reaction forces $F_{outer}$ are not equal due to the different load from the slab 18, because the misaligned roller portion 36 cannot support the slab 18 as much as the aligned roller portion is able to support the slab 18. Thus, when comparing the two forces $F_{inner}$ with each other there will be a divergence or difference, just as there will also be a divergence or difference between the two forces $F_{outer}$.

By providing each supporting member 20 with a measuring device 24, it is possible to detect misaligned roller portions according to this method. This measuring device 24 is able to measure the radial force F acting in the supporting member 20 due to the load of the slab 18 acting on the roller 10. Measuring devices for measuring the radial force or load are known and can be employed. Preferably, the measuring is carried out in the beginning of the casting process, but it can of course also be carried out later in the process to detect eventual failures of the roller portions 22.

The principles, preferred embodiments and modes of operation of the present invention have been described in the foregoing specification. However, the invention which is intended to be protected is not to be construed as limited to the particular embodiments disclosed. Further, the embodiments described herein are to be regarded as illustrative rather than restrictive. Variations and changes may be made by others, and equivalents employed, without departing from the spirit of the present invention. Accordingly, it is expressly intended that all such variations, changes and equivalents which fall within the spirit and scope of the present invention as defined in the claims, be embraced thereby.

What is claimed is:

1. Method for detecting a misaligned roller portion of a roller in a continuous casting machine, the continuous casting machine comprising a plurality of rollers arranged in a row after each other with the rollers being divided into at least two roller portions each rotatably mounted in a supporting member and arranged for transporting material produced in the machine, the method comprising:

measuring a radial load value exerted by the material on each supporting member of the roller portions of a roller;

comparing the radial load values of the supporting members arranged at outer ends of the roller with each other;

comparing the radial load values of the supporting members arranged at inner ends of the roller with each other; and establishing a presence of a misaligned roller portion where a divergence between the radial load values of the supporting members at the outer ends of the roller and/or where a divergence between the radial load values of the supporting members of the inner ends of the roller exceed a predetermined value.

2. Method according to claim 1, wherein the supporting members comprise a measuring device which measures the radial load values.

3. Method according to claim 1, wherein the supporting members are rolling bearings.

4. Method according to claim 1, wherein the supporting members are sliding bearings.

5. Method for detecting a misaligned roller portion of a roller in a continuous casting machine, comprising:

transporting material produced in the continuous casting machine along a plurality of rollers arranged in a row one after another, with at least one of the rollers being divided into at least two roller portions positioned axially adjacent one another and each rotatably mounted in two supporting members so that a supporting member is arranged at a first end of each roller portion and at a second end of each roller portion;

measuring a radial load value exerted by the material on the supporting members arranged at the first ends of the roller portions or the supporting members arranged at the second ends of the roller portions;

comparing the measured radial load values of the supporting members with each other; and determining at least one of the roller portions is misaligned when the comparison of the measured radial load values of the supporting members reveals that a divergence between the measured radial load values of the two supporting members exceeds a predetermined value.

6. Method according to claim 5, wherein the supporting members comprise a measuring device which measures the radial load values.

7. Method according to claim 5, wherein the supporting members are rolling bearings.

8. Method according to claim 5, wherein the supporting members are sliding bearings.

9. Method for detecting a misaligned roller portion of a roller in a continuous casting machine, comprising:

transporting material produced in the continuous casting machine along a plurality of rollers arranged in a row one after another, with at least some of the rollers being divided into at least two roller portions positioned axially adjacent one another and each rotatably mounted in supporting members so that a supporting member is arranged at each outer end of the at least one roller and at each inner end of the at least one roller;

measuring a radial load value exerted by the material on the supporting members arranged at the outer ends of at least one roller;

measuring a radial load value exerted by the material on the supporting members arranged at the inner ends of at least one roller;

comparing the radial load values of the supporting members arranged at the outer ends of the at least one roller with each other;

comparing the radial load values of the supporting members arranged at the inner ends of the at least roller with each other; and establishing that at least one of the roller portions is misaligned when a divergence between the radial load values of the supporting members at the outer ends of the at least roller and/or when a divergence between the radial load values of the supporting members of the inner ends of the at least one roller exceeds a predetermined value.

10. Method according to claim 9, wherein the supporting members comprise a measuring device which measures the radial load values.

11. Method according to claim 9, wherein the supporting members are rolling bearings.

12. Method according to claim 9, wherein the supporting members are sliding bearings.

* * * * *